US011178953B2

(12) United States Patent
Lee

(10) Patent No.: US 11,178,953 B2
(45) Date of Patent: Nov. 23, 2021

(54) COSMETIC CONTAINER HAVING DISCHARGE HOLE AUTOMATICALLY OPENED/CLOSED BY OVERCAP

(71) Applicant: PUM-TECH KOREA CO., LTD, Incheon (KR)

(72) Inventor: Do Hoon Lee, Incheon (KR)

(73) Assignee: PUM-TECH KOREA CO., LTD, Incheon (KR)

( * ) Notice: Subject to any disclaimer, the term of this patent is extended or adjusted under 35 U.S.C. 154(b) by 0 days.

(21) Appl. No.: 16/759,280

(22) PCT Filed: Oct. 24, 2018

(86) PCT No.: PCT/KR2018/012567
§ 371 (c)(1),
(2) Date: Apr. 24, 2020

(87) PCT Pub. No.: WO2019/093686
PCT Pub. Date: May 16, 2019

(65) Prior Publication Data

US 2020/0337434 A1 Oct. 29, 2020

(30) Foreign Application Priority Data

Nov. 13, 2017 (KR) ..... 10-2017-0150231

(51) Int. Cl.
*A45D 34/04* (2006.01)
*A45D 40/26* (2006.01)
(Continued)

(52) U.S. Cl.
CPC ..... *A45D 34/04* (2013.01); *A45D 40/26* (2013.01); *A46B 9/005* (2013.01); *A46B 11/0041* (2013.01); *A45D 2200/054* (2013.01)

(58) Field of Classification Search
CPC ..... A45D 34/00; A45D 34/04; A45D 40/26; A45D 2200/051; A45D 2200/054; A46B 9/005; A46B 11/0041; B65D 85/14
See application file for complete search history.

(56) References Cited

U.S. PATENT DOCUMENTS 2,695,737 A * 11/1954 Schlicksupp ..... A45D 34/04 222/513
6,533,482 B1 * 3/2003 Byun ..... A45D 34/04 401/180
(Continued)

FOREIGN PATENT DOCUMENTS

KR 20-0385091 Y1 5/2005
KR 20-2012-0008410 U 12/2012
(Continued)

*Primary Examiner* — J C Jacyna
(74) *Attorney, Agent, or Firm* — Heedong Chae; Lucem, PC

(57) ABSTRACT

The present invention relates to a cosmetic container having a discharge hole automatically opened/closed by an overcap, the cosmetic container comprising: a container body for containing a cosmetic material; and an overcap for opening/closing the container body. The container body comprises a shoulder coupled to an entrance portion thereof and having a first discharge hole, wherein an operation member is configured to be horizontally contracted by the overcap and an opening/closing member is configured to open/close the first discharge hole of the shoulder while being vertically moved by the operation member. When the overcap is put on, the operation member is pushed into the shoulder by the inner periphery of the overcap, and the opening/closing member is pushed downward simultaneously by the operation member to automatically open/close the first discharge hole of the shoulder, thereby easily sealing the container body.

7 Claims, 9 Drawing Sheets

(51) Int. Cl.
*A46B 9/00* (2006.01)
*A46B 11/00* (2006.01)

(56) References Cited

U.S. PATENT DOCUMENTS

| | | | | |
|---|---|---|---|---|
| 7,384,208 | B2 * | 6/2008 | Bouix | A45D 34/04 401/202 |
| 10,040,082 | B1 * | 8/2018 | Liu | A45D 34/04 |
| 2010/0243677 | A1 * | 9/2010 | Lim | B05B 11/3015 222/256 |
| 2012/0321368 | A1 * | 12/2012 | Lim | B05B 11/3052 401/118 |
| 2013/0146618 | A1 * | 6/2013 | Bae | A45D 34/04 222/183 |
| 2014/0079463 | A1 * | 3/2014 | Byun | A45D 34/04 401/136 |
| 2016/0360855 | A1 * | 12/2016 | Byun | A45D 34/042 |
| 2019/0269221 | A1 * | 9/2019 | Jung | B65D 51/248 |

FOREIGN PATENT DOCUMENTS

| | | | |
|---|---|---|---|
| KR | 10-1242196 | B1 | 3/2013 |
| KR | 10-2014-0009911 | A | 1/2014 |
| KR | 20-2015-0000015 | U | 1/2015 |

* cited by examiner

COSMETIC CONTAINER HAVING DISCHARGE HOLE AUTOMATICALLY OPENED/CLOSED BY OVERCAP

TECHNICAL FIELD

The present invention relates to a cosmetic container having a discharge hole automatically opened/closed by an overcap, and more particularly, to a cosmetic container having a discharge hole automatically opened/closed by an overcap, in which the cosmetic container includes a container body for accommodating a cosmetic material and the overcap for opening/closing the container body, a shoulder having a first discharge hole is coupled to an entrance portion of the container body, an operation member horizontally contracted by the overcap and an opening/closing member vertically moved by the operation member to open/close the first discharge hole of the shoulder are provided, and when the overcap is closed, an inner peripheral surface of the overcap pushes the operation member into the shoulder, and the operation member simultaneously pushes the opening/closing member downward, so that the opening/closing member automatically closes the first discharge hole of the shoulder. Accordingly, the container body is easily sealed, and an elastic rebounding force of the opening/closing member is horizontally applied through the operation member so that the overcap is prevented from being easily separated by an external impact.

BACKGROUND ART

A cosmetic product is a product used for beautifying the appearance of a human body and covering defects of the appearance to make the appearance look attractive, or for maintaining the health of skin, hair, and the like.

The cosmetic product is classified into basic cosmetics, color cosmetics, and functional cosmetics according to the purpose of use, and manufactured in a liquid or gel form or a solid or powder form according to characteristics thereof so as to be stored in various types of cosmetic containers for use.

Accordingly, it is necessary to develop a container for various types of cosmetic materials. In general, for usability and convenience, a liquid or gel cosmetic material is used in a manner that the liquid or gel cosmetic material is filled in a tube container, and applied onto the skin by a user through drawing some of the liquid or gel cosmetic material on a hand or by using a cosmetic tool upon use.

However, since a separate cosmetic tool is necessary in order to use the conventional gel cosmetic material, there is a high probability of losing the cosmetic tool. In addition, since the cosmetic tool has to be separately stored, portability is not preferable.

In order to solve the above-described problems, as shown in FIG. 1, Korean Unexamined Patent Publication No. 10-2016-0053700 discloses a configuration including a body for accommodating a content, an applicator formed integrally with an upper portion of the body and formed on one side thereof with a discharge hole, and an overcap coupled to the body while surrounding the applicator, wherein while the content in the body is squeezed out, the content is discharged to the discharge hole of the applicator, so that the applicator may be conveniently used, and wherein in order to seal the content in the body when the overcap is closed, a sealing rod formed at an inner side of the overcap is inserted into the discharge hole of the applicator to seal the discharge hole.

However, according to the related art, since the sealing rod elongates and extends downward from the inner side of the overcap, the sealing rod may be broken while being inserted into the discharge hole of the applicator. In addition, since the sealing rod is formed at the inner side of the overcap, it is difficult to accurately insert the sealing rod into the discharge hole.

In order to solve the above-described problems, as shown in FIG. 2, Korean Patent Registration No. 10-0916626 has been disclosed. According to the related art, when the cap is closed, an opening/closing rod inside a shoulder descends so as to block a powder discharge hole so that a powder may be prevented from being discharged, and when the cap is opened, the opening/closing rod of the shoulder ascends due to elasticity of a compression coil spring so as to open the powder discharge hole so that the powder may be discharged.

However, in the related art, when the cap is rotated and coupled to a container, an elastic portion pressed by the cap is rotated together with the cap so as to be twisted and broken.

In addition, the container and the cap according to the related art have an undercut coupling structure, so that an elastic rebounding force of the compression coil spring consistently pushes the cap upward. Accordingly, the cap is separated from the container so as to be opened even with a small external impact.

Further, according to the related art, makeup is performed while the compression coil spring elastically supports a cosmetic tool, so that the cosmetic tool is pressed so as to block the discharge hole when the makeup is performed, thereby interfering with the discharge of a cosmetic material.

DISCLOSURE

Technical Problem

To solve the problems described above, an object of the present invention is to provide a cosmetic container having a discharge hole automatically opened/closed by an overcap, in which the cosmetic container includes a container body for accommodating a cosmetic material and the overcap for opening/closing the container body, a shoulder having a first discharge hole is coupled to an entrance portion of the container body, an operation member horizontally contracted by the overcap and an opening/closing member vertically moved by the operation member to open/close the first discharge hole of the shoulder are provided, and when the overcap is closed, an inner peripheral surface of the overcap pushes the operation member into the shoulder, and the operation member simultaneously pushes the opening/closing member downward, so that the opening/closing member automatically closes the first discharge hole of the shoulder. Accordingly, the container body may be easily sealed, and an elastic rebounding force of the opening/closing member may be horizontally applied through the operation member so that the overcap may be prevented from being easily separated by an external impact.

In addition, an object of the present invention is to provide a cosmetic container having a discharge hole automatically opened/closed by an overcap, in which a shoulder having a first discharge hole is fixedly coupled to a container body, and a cosmetic tool having a second discharge hole is attached to the shoulder, so that the first discharge hole is connected to the second discharge hole such that the cosmetic tool is prevented from affecting opening/closing of the first discharge hole even if the cosmetic tool is pressed in any direction. Accordingly, when makeup is performed by using the cosmetic tool, a cosmetic material accommodated in the container body may be discharged to an outside without being interfered by the cosmetic tool, so that convenience of use may be improved.

Technical Solution

According to the present invention, there is provided a cosmetic container having a discharge hole automatically opened/closed by an overcap, the cosmetic container including:

a container body in which a cosmetic material is accommodated;

the overcap for opening/closing the container body;

a shoulder coupled to the container body and having a first discharge hole;

an operation member horizontally contracted by the overcap;

an opening/closing member vertically moved by the operation member to open/close the first discharge hole of the shoulder; and an elastic member for elastically supporting the opening/closing member.

In addition, the overcap may include an inner overcap and an outer overcap, and when the overcap is closed, an inclined portion formed in the inner overcap may push the operation member into the shoulder to seal the container body.

In addition, a cosmetic tool having a second discharge hole may be coupled to the shoulder, and the second discharge hole of the cosmetic tool may be connected to the first discharge hole of the shoulder.

In addition, the shoulder may include an inner shoulder coupled to an entrance portion of the container body and an outer shoulder coupled to an upper portion of the inner shoulder, and the outer shoulder may be formed at an outer periphery thereof with a pressing portion through-hole.

In addition, the operation member may be formed at both sides thereof with a horizontal pressing portion and may include an elastic supporting portion for elastically supporting the horizontal pressing portion in an outward direction.

In addition, the opening/closing member may be formed at a center thereof with an opening/closing portion and may include a vertical pressing portion formed at an outer side of the opening/closing portion so as to be vertically pressed by the operation member.

In addition, the operation member may include a first inclined portion, and the opening/closing member may include a second inclined portion having an inclined groove, so that the first inclined portion of the operation member may be seated in the inclined groove of the opening/closing member.

In addition, when the overcap is closed, an inner peripheral surface of the overcap may push the operation member into the shoulder, and the operation member may simultaneously push the opening/closing member downward, so that the opening/closing member may close the first discharge hole of the shoulder, and when the overcap is opened, the operation member may be elastically restored to an original position thereof, and the opening/closing member may be simultaneously moved upward by elasticity of the elastic member so as to open the first discharge hole of the shoulder.

Advantageous Effects

According to the present invention, in the cosmetic container having the discharge hole automatically opened/closed by the overcap, the shoulder having the first discharge hole is coupled to the entrance portion of the container body, the operation member horizontally contracted by the overcap and the opening/closing member vertically moved by the operation member to open/close the first discharge hole of the shoulder are provided, and when the overcap is closed, the inner peripheral surface of the overcap pushes the operation member into the shoulder, and the operation member simultaneously pushes the opening/closing member downward, so that the opening/closing member automatically closes the first discharge hole of the shoulder. Accordingly, the container body can be easily sealed, and an elastic rebounding force of the opening/closing member can be horizontally applied through the operation member so that the overcap can be prevented from being easily separated by an external impact.

In addition, according to the present invention, in the cosmetic container having the discharge hole automatically opened/closed by the overcap, the shoulder having the first discharge hole is fixedly coupled to the container body, and the cosmetic tool having the second discharge hole is attached to the shoulder, so that the first discharge hole is connected to the second discharge hole such that the cosmetic tool is prevented from affecting the opening/closing of the first discharge hole even if the cosmetic tool is pressed in any direction. Accordingly, when the makeup is performed by using the cosmetic tool, the cosmetic material accommodated in the container body can be discharged to an outside without being interfered by the cosmetic tool, so that convenience of use can be improved.

MODE FOR INVENTION

Best Mode

The present invention and the technical objects to be achieved by implementing the present invention will be apparent by preferred embodiments which will be described as follows. Hereinafter, a cosmetic container having a discharge hole automatically opened/closed by an overcap according to one embodiment of the present invention will be described in detail with reference to the accompanying drawings.

Figure 1:
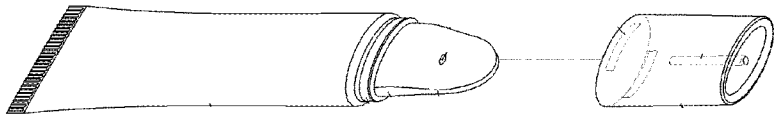
FIG. 1 is a container having a flexible applicator according to the related art.
Figure 2:
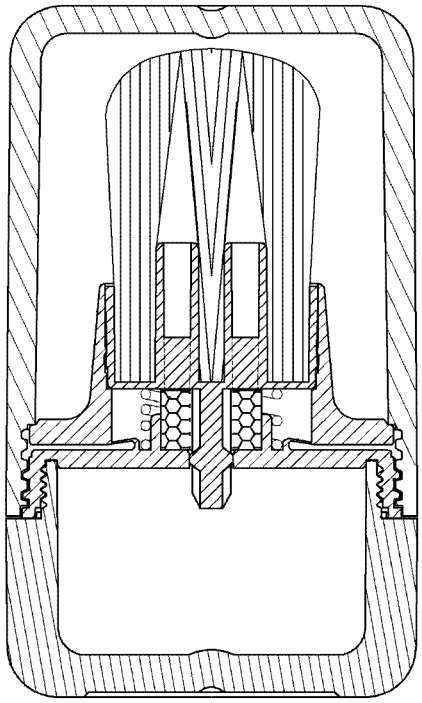
FIG. 2 is a cosmetic case for discharging a powder according to the related art.
Figure 3:
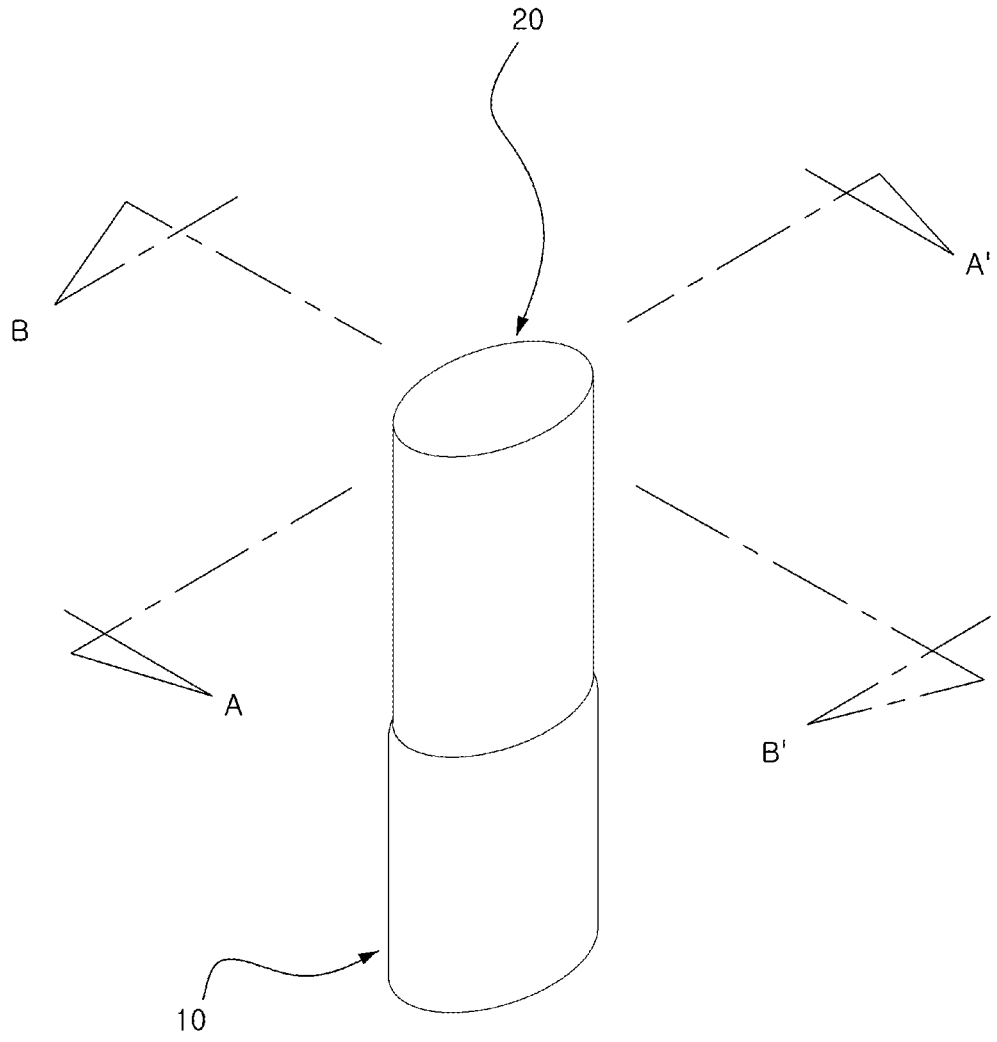
FIG. 3 is a perspective view showing a cosmetic container according to one embodiment of the present invention.
Figure 4:
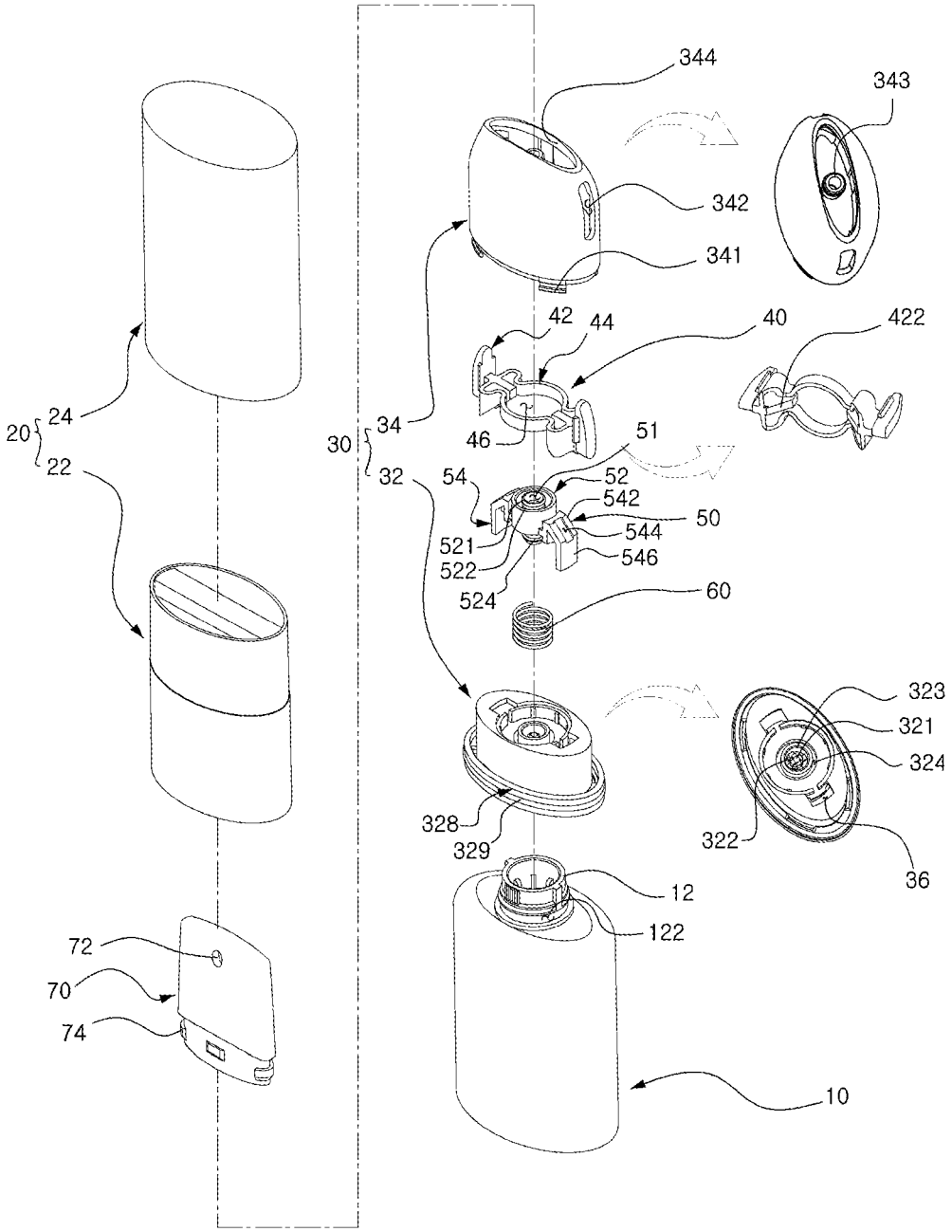
FIG. 4 is an exploded perspective view showing a cosmetic container according to one embodiment of the present invention.
Figure 5:
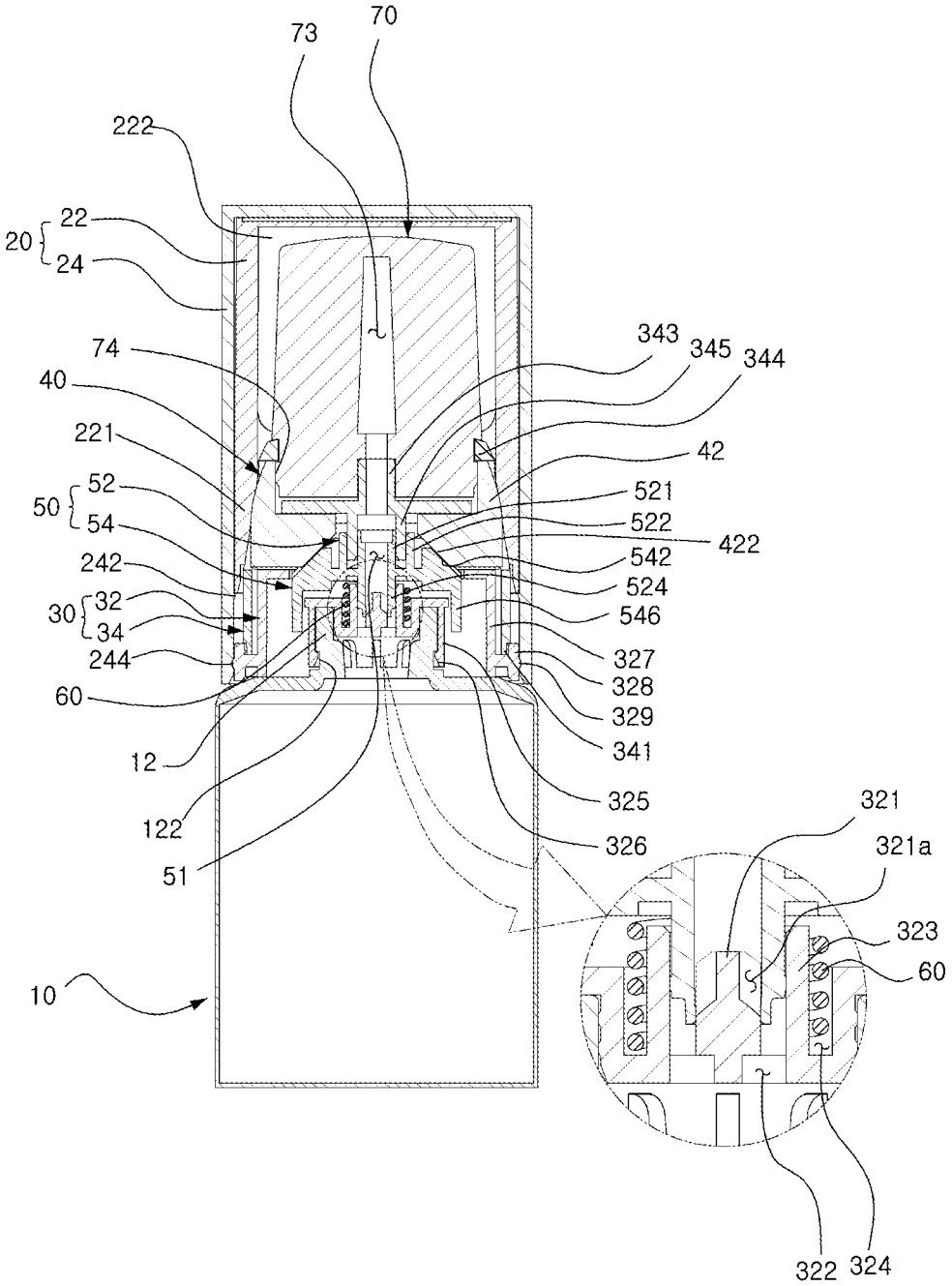
FIG. 5 is a sectional view taken along line A-A of the cosmetic container according to one embodiment of the present invention.
Figure 6:
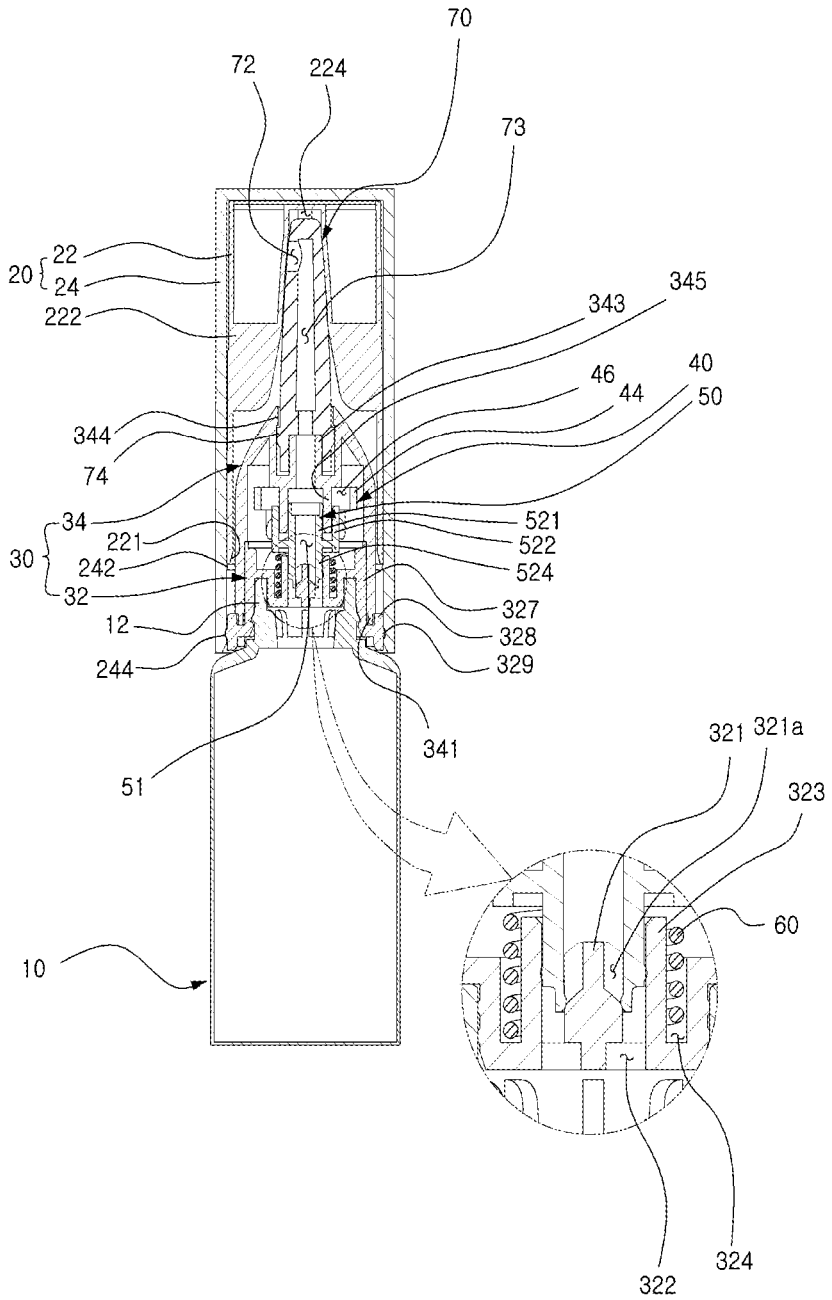
FIG. 6 is a sectional view taken along line B-B of the cosmetic container according to one embodiment of the present invention.

FIG. 3 is a perspective view showing a cosmetic container according to one embodiment of the present invention, FIG. 4 is an exploded perspective view showing a cosmetic container according to one embodiment of the present invention, FIG. 5 is a sectional view taken along line A-A of the cosmetic container according to one embodiment of the present invention, and FIG. 6 is a sectional view taken along line B-B of the cosmetic container according to one embodiment of the present invention.

According to one embodiment of the present invention, a cosmetic container having a discharge hole automatically opened/closed by an overcap may include: a container body 10 in which a cosmetic material is accommodated; an overcap 20 for opening/closing the container body 10; a shoulder 30 coupled to the container body 10 and having a first discharge hole 322; an operation member 40 horizontally contracted by the overcap 20; an opening/closing member 50 vertically moved by the operation member 40 to open/close the first discharge hole 322 of the shoulder 30; and an elastic member 60 for elastically supporting the opening/closing member 50.

A gel or liquid cosmetic material may be accommodated in the container body 10, and as shown in FIG. 4, the container body 10 may be formed at an upper portion thereof with an entrance portion 12, and a coupling ring groove 122 may be formed at an outer periphery of the entrance portion 12 so as to be coupled with the shoulder 30.

The container body 10 is preferably configured as a soft tube container so that the cosmetic material may be discharged to an outside as the shape of the container body 10 is deformed when a user presses the container body 10.

As shown in FIGS. 3 and 5, the overcap 20 may be detachably attached to the upper portion of the container body 10 to expose or conceal a cosmetic tool 70 to or from the outside.

The overcap 20 may include an inner overcap 22 and an outer overcap 24 as shown in FIG. 4.

The inner overcap 22 may be formed at a lower portion thereof with an inclined portion 221. When the overcap 20 is closed, the inclined portion 221 may push the operation member 40 into the shoulder 30 to seal the container body 10. In other words, when the overcap 20 is closed, the inclined portion 221 of the inner overcap 22 may smoothly push an outer periphery of a horizontal pressing portion 42 of the operation member 40 into the shoulder 30 to actuate a sealing structure.

As shown in FIG. 6, the inner overcap 22 may be formed at an inner side thereof with a sealing portion 222, and the sealing portion 222 may be formed at a center thereof with a sealing groove 224 corresponding to the cosmetic tool 70, so that the cosmetic tool 70 may be inserted into the sealing groove 224 when the overcap 20 is closed.

Preferably, both sides of an inlet of the sealing groove 224 of the inner overcap 22 may have a round shape so that the cosmetic tool 70 may be easily inserted.

The inner overcap 22 may be formed of a soft material, and particularly, the inner overcap 22 is preferably formed of a polypropylene or polyethylene material having elasticity.

As shown in FIG. 6, when the overcap 20 is coupled to the upper portion of the container body 10, as the cosmetic tool 70 formed of a flexible material is inserted into the sealing groove 224 of the inner overcap 22, the sealing portion 222 may make tight contact with an outer peripheral surface of the cosmetic tool 70 so as to block a second discharge hole 72 of the cosmetic tool 70, so that a sealing force of the container body 10 may be further improved.

A separation preventing protrusion 242 may be formed at an inner periphery of the outer overcap 24 of the overcap 20 to prevent the inner overcap 22 coupled to an inside of the outer overcap 24 from being separated, and the separation preventing protrusion 242 may be formed at a lower portion thereof with a fastening ring groove 244 coupled to the shoulder 30.

As shown in FIG. 5, the shoulder 30 may be coupled to the entrance portion 12 of the container body 10 while surrounding the entrance portion 12 of the container body 10.

As shown in FIG. 4, the shoulder 30 may include an inner shoulder 32 coupled to the entrance portion 12 of the container body 10 and an outer shoulder 34 coupled to an upper portion of the inner shoulder 32.

An opening/closing rod 321 may protrude upward from a center of the inner shoulder 32 of the shoulder 30, and the opening/closing rod 321 may be formed at an outer side thereof with a first discharge hole 322 connected to an inside of the container body 10. As shown in a partially enlarged view of FIG. 5, the opening/closing rod 321 may be formed at an upper outer periphery thereof with a discharge groove 321*a*.

An upper inner wall 323 may extend upward while being spaced outward from the opening/closing rod 321 by a predetermined interval, and an elastic member insertion space 324 in which the elastic member 60 is installed may be formed on an outer side of the upper inner wall 323.

As shown in FIG. 5, a lower inner wall 325 may extend downward from an outer side of the elastic member insertion space 324, and a coupling protrusion wheel 326 may protrude inward from an inner periphery of the lower inner wall 325 so as to be coupled to the coupling ring groove 122 of the container body 10.

A lower outer wall 327 may extend downward while being spaced outward from the lower inner wall 325 by a predetermined interval, a fastening portion 328 may be spaced outward from the lower outer wall 327 by a predetermined interval, and a fastening protrusion wheel 329 may protrude outward from an outer periphery of the fastening portion 328 so as to be coupled to the fastening ring groove 244 of the overcap 20.

The lower inner wall 325 of the inner shoulder 32 may be formed at an outer side thereof with a guide hole 36 for guiding a vertical movement of the opening/closing member 50.

As shown in FIGS. 5 and 6, the outer shoulder 34 of the shoulder 30 may be coupled to the upper portion of the inner shoulder 32 while covering the upper portion of the inner shoulder 32.

The outer shoulder 34 may be formed at a lower portion thereof with a coupling portion 341 inserted and coupled between the lower outer wall 327 and the fastening portion 328 of the inner shoulder 32.

As shown in FIG. 4, the outer shoulder 34 may be formed at an outer periphery thereof with a pair of pressing portion through-holes 342 which exposes the horizontal pressing portion 42 of the operation member 40 to an outside of the shoulder 30.

As shown in FIG. 5, an upper extension protrusion wheel 343 may extend upward from an upper center of the outer shoulder 34 so as to be fitted with the cosmetic tool 70, and a lower extension protrusion wheel 345 may extend downward from a lower center of the outer shoulder 34 so as to be fitted with the opening/closing member 50 while passing through the operation member 40.

A fitting protrusion wheel 344 may protrude inward from an upper inner side of the outer shoulder 34 so as to be coupled to a fitting protrusion 74 of the cosmetic tool 70.

When the overcap 20 is closed, the operation member 40 may be contracted into the shoulder 30 while being horizontally pushed by the inclined portion 221 of the inner overcap 22.

As shown in FIG. 4, the operation member 40 may be formed at both sides thereof with a horizontal pressing portion 42, and may include an elastic supporting portion 44 for elastically supporting the horizontal pressing portion 42 in an outward direction.

A pair of horizontal pressing portions 42 may be arranged to face each other. An outer peripheral surface of the horizontal pressing portion 42 is preferably formed as a smooth curved surface so as to be easily pressed by the inclined portion 221 of the inner overcap 22.

The horizontal pressing portion 42 may be formed at an inner lower portion thereof with a first inclined portion 422, and the first inclined portion 422 may be inclined outward in a downward direction and seated in an inclined groove 544 which is formed in a second inclined portion 542 of the opening/closing member 50.

The elastic supporting portion 44 may be formed on an inner side of the horizontal pressing portion 42 to elastically support the horizontal pressing portion 42 in a horizontal direction.

As shown in FIG. 4, a pair of elastic supporting portions 44 having a curved shape is preferably arranged to face each other in order to have an elastic force.

The elastic supporting portion 44 may be formed at a center thereof with a through-hole 46, and the lower extension protrusion wheel 345 of the outer shoulder 34 and first and second upper extension protrusion wheels 521 and 522 of the opening/closing member 50 may pass through the through-hole 46.

The opening/closing member 50 may be vertically moved by the operation member 40 to open/close the first discharge hole 322 of the shoulder 30.

As shown in FIG. 4, the opening/closing member 50 may be formed at a center thereof with an opening/closing portion 52, and may include a vertical pressing portion 54 formed at an outer side of the opening/closing portion 52 so as to be vertically pressed by the operation member 40.

The first upper extension protrusion wheel 521 may extend upward from an upper center of the opening/closing portion 52, and the second upper extension protrusion wheel 522 may extend upward while being spaced outward from the first upper extension protrusion wheel 521 by a predetermined interval. The lower extension protrusion wheel 345 of the outer shoulder 34 may be inserted between the first and second upper extension protrusion wheels 521 and 522.

An opening/closing protrusion wheel 524 may extend downward from a lower center of the opening/closing portion 52, and the opening/closing protrusion wheel 524 may be inserted between the opening/closing rod 321 and the upper inner wall 323 of the inner shoulder 32 as shown in the partially enlarged view of FIG. 5, such that an inner periphery of the opening/closing protrusion wheel 524 makes close contact with an outer periphery of the opening/closing rod 321, and an outer periphery of the opening/closing protrusion wheel 524 makes close contact with an inner periphery of the upper inner wall 323.

In other words, when the opening/closing protrusion wheel 524 is moved downward, as shown in the partially enlarged view of FIG. 5, the opening/closing protrusion wheel 524 may surround the outer periphery of the opening/closing rod 321 to block the discharge groove 321*a* so that the first discharge hole 322 may be blocked. In addition, when the opening/closing protrusion wheel 524 is moved upward, as shown in a partially enlarged view of FIG. 7, a lower end of the opening/closing protrusion wheel 524 may be located at an upper side of the discharge groove 321*a* of the opening/closing rod 321 so that the discharge groove 321*a* may be opened, and thus the first discharge hole 322 of the inner shoulder 32 may be opened.

As described above, the opening/closing protrusion wheel 524 may be located between the opening/closing rod 321 and the upper inner wall 323, that is, at an upper portion of the first discharge hole 322, so that the opening/closing protrusion wheel 524 may move up or down to open or block the first discharge hole 322.

A first discharge flow path 51 may be formed inside the first upper extension protrusion wheel 521 and the opening/closing protrusion wheel 524 of the opening/closing portion 52 to serve as a passage for moving the cosmetic material accommodated in the container body 10 from the first discharge hole 322 to the second discharge hole 72 through a second discharge flow path 73.

A pair of vertical pressing portions 54 may be arranged on both sides of the opening/closing portion 52 to face each other.

The vertical pressing portion 54 may be formed at an upper portion thereof with the second inclined portion 542 corresponding to the first inclined portion 422 of the operation member 40, and the second inclined portion 542 may have the inclined groove 544 in which the first inclined portion 422 is seated.

A lower extension piece 546 may extend downward from a lower portion of the second inclined portion 542 of the vertical pressing portion 54, and the lower extension piece 546 may pass through the guide hole 36 formed in the inner shoulder 32 as shown in FIG. 5.

According to the above configuration, when the overcap 20 is closed as shown in FIG. 5, the inclined portion 221 of the inner overcap 22 may push the operation member 40 into the shoulder 30, and the operation member 40 may simultaneously push the opening/closing member 50 downward, so that the opening/closing member 50 may block the discharge groove 321*a* of the inner shoulder 32 so as to block the first discharge hole 322. In addition, when the overcap 20 is opened as shown in FIG. 7, the operation member 40 may be elastically restored to an original position thereof, and the opening/closing member 50 may be simultaneously moved upward by elasticity of the elastic member 60, so that the opening/closing member 50 may open the discharge groove 321*a* of the inner shoulder 32 so as to open the first discharge hole 322.

The elastic member 60 may be installed inside the shoulder 30 to elastically support the opening/closing member 50.

A lower portion of the elastic member 60 may be inserted into the elastic member insertion space 324 of the inner shoulder 32, and an upper portion of the elastic member 60 may make close contact with a bottom surface of the opening/closing member 50.

Figure 7:
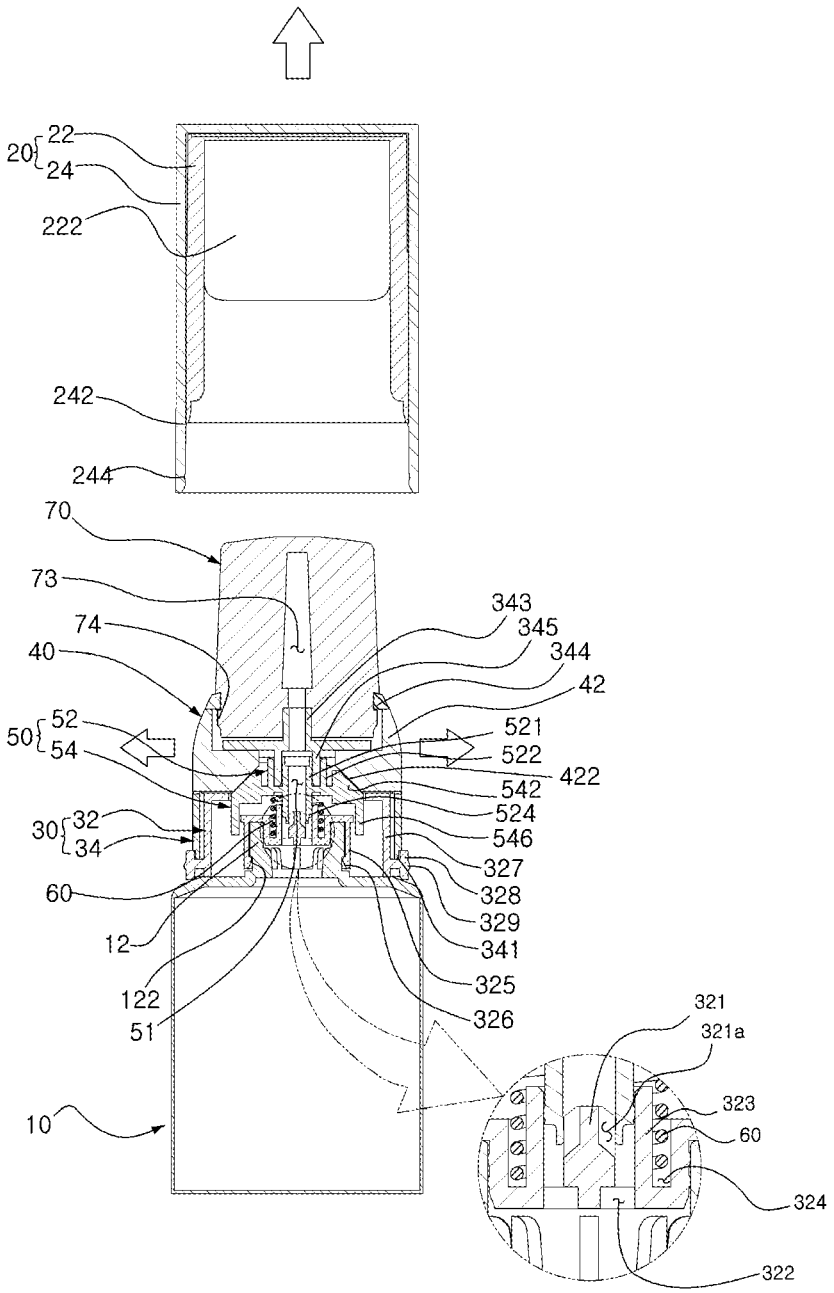
FIG. 7 is a sectional view taken along line A-A to show a state in which an overcap of the cosmetic container is separated according to one embodiment of the present invention.

In other words, when the overcap 20 is opened, as shown in FIG. 7, the elastic member 60 may serve to move the operation member 40, which is contracted by the overcap 20, and the opening/closing member 50, which is pressed down by the operation member 40, back to original positions thereof.

The cosmetic tool 70 may be coupled to an upper portion of the shoulder 30 so that the user may conveniently use the cosmetic tool 70 when performing makeup.

The cosmetic tool 70 may have the second discharge hole 72 for discharging the cosmetic material accommodated in the container body 10 to the outside, in which the second discharge hole 72 may be formed in one side surface of the cosmetic tool 70 as shown in FIG. 5.

As shown in FIG. 6, the second discharge flow path 73 may be formed inside the cosmetic tool 70, in which the second discharge flow path 73 may be connected to the first discharge flow path 51 of the opening/closing member 50 so as to serve to move the cosmetic material to the second discharge hole 72.

As shown in FIG. 5, the cosmetic tool 70 may be formed at an outer peripheral surface thereof with the fitting protrusion 74 which is undercut-coupled to the fitting protrusion wheel 344 of the outer shoulder 34.

The cosmetic tool 70 preferably has a plate shape with a wide width to spread contents widely onto skin.

In addition, the cosmetic tool 70 may be formed of a flexible material so as to be flexibly bent, and particularly, the cosmetic tool 70 is preferably formed of a material including at least one of silicone, urethane rubber, natural rubber, elastomer, nitrile-butadiene rubber (NBR), acrylonitrile butadiene styrene (ABS), or thermos-plastic elastomer (TPE).

Hereinafter, a method of assembling the cosmetic container having the discharge hole automatically opened/closed by the overcap, which has a configuration as described above, will be described.

In order to assemble the cosmetic container having the discharge hole automatically opened/closed by the overcap according to the present invention, as shown in FIGS. 4 and 5, the container body 10 may be filled with the cosmetic material.

Next, the inner shoulder 32 may be coupled to the entrance portion 12 of the container body 10, such that the lower inner wall 325 of the inner shoulder 32 may surround the entrance portion 12 of the container body 10, and the coupling ring groove 122 of the container body 10 may be coupled to the coupling protrusion wheel 326 of the inner shoulder 32.

Thereafter, the opening/closing member 50 may be inserted into the upper portion of the inner shoulder 32, such that the opening/closing protrusion wheel 524 of the opening/closing member 50 may be inserted between the opening/closing rod 321 and the upper inner wall 323 of the inner shoulder 32.

Then, the operation member 40 may be seated on an upper portion of the opening/closing member 50, such that the first inclined portion 422 of the operation member 40 may be inserted into the inclined groove 544 of the opening/closing member 50.

Next, the outer shoulder 34 may be coupled to the upper portion of the inner shoulder 32, such that while the outer shoulder 34 surrounds the operation member 40, the opening/closing member 50, and the inner shoulder 32, the coupling portion 341 of the outer shoulder 34 may be inserted and coupled between the lower outer wall 327 and the fastening portion 328 of the inner shoulder 32.

In this case, the lower extension protrusion wheel 345 of the outer shoulder 34 may be inserted between the first and second upper extension protrusion wheels 521 and 522 of the opening/closing member 50 while passing through the through-hole 46 of the operation member 40, and the horizontal pressing portion 42 of the operation member 40 may pass through the pressing portion through-hole 342 of the outer shoulder 34 so as to be exposed to the outside.

Thereafter, the cosmetic tool 70 may be coupled to an upper portion of the outer shoulder 34, such that the fitting protrusion wheel 344 of the outer shoulder 34 may be undercut-coupled to the fitting protrusion 74 of the cosmetic tool 70.

Finally, the overcap 20 may be coupled to the upper portion of the container body 10, thereby completing the assembly of the cosmetic container having the discharge hole automatically opened/closed by the overcap according to the present invention.

Hereinafter, the use of the cosmetic container having the discharge hole automatically opened/closed by the overcap, which is assembled as described above, will be described.

Figure 8:
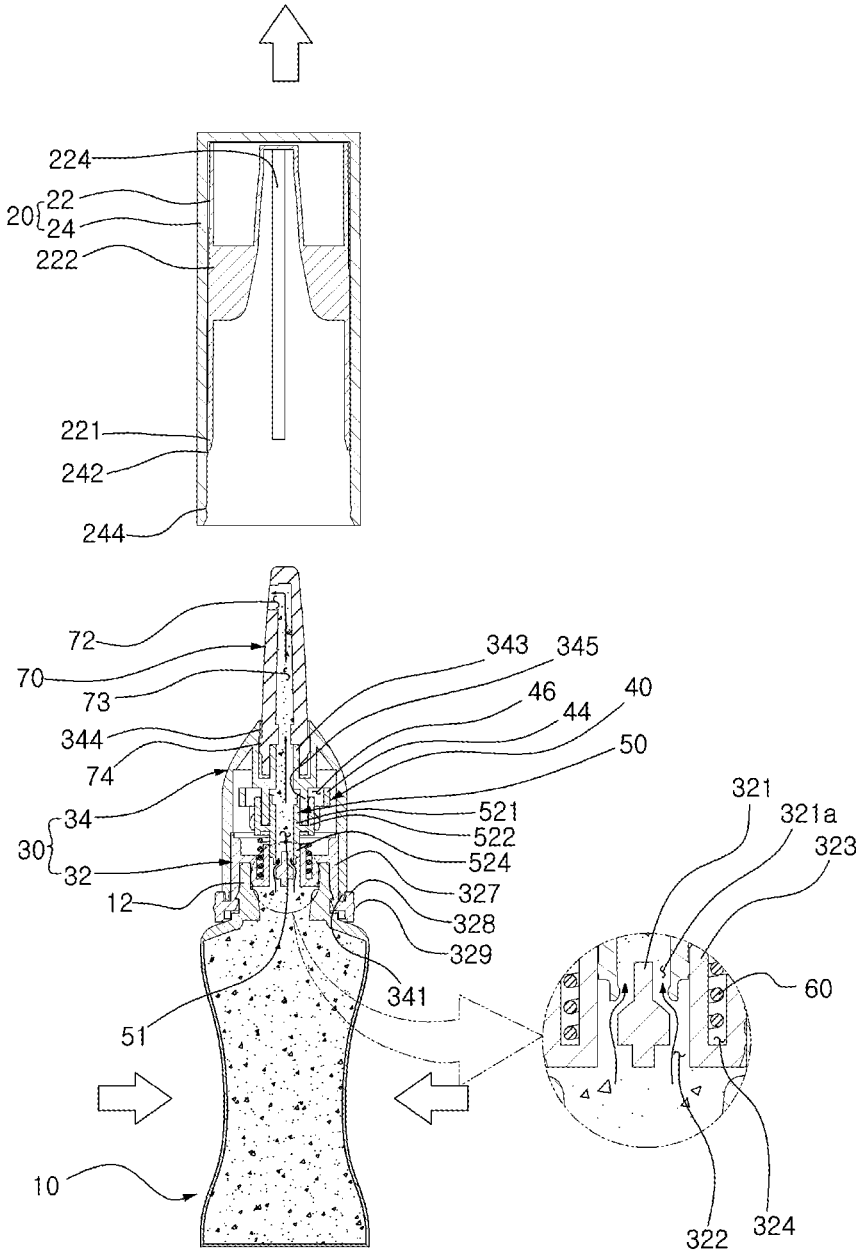
FIG. 8 is a sectional view taken along line B-B to show a state in which a cosmetic material is discharged by pressing a container body of the cosmetic container according to one embodiment of the present invention.
Figure 9:
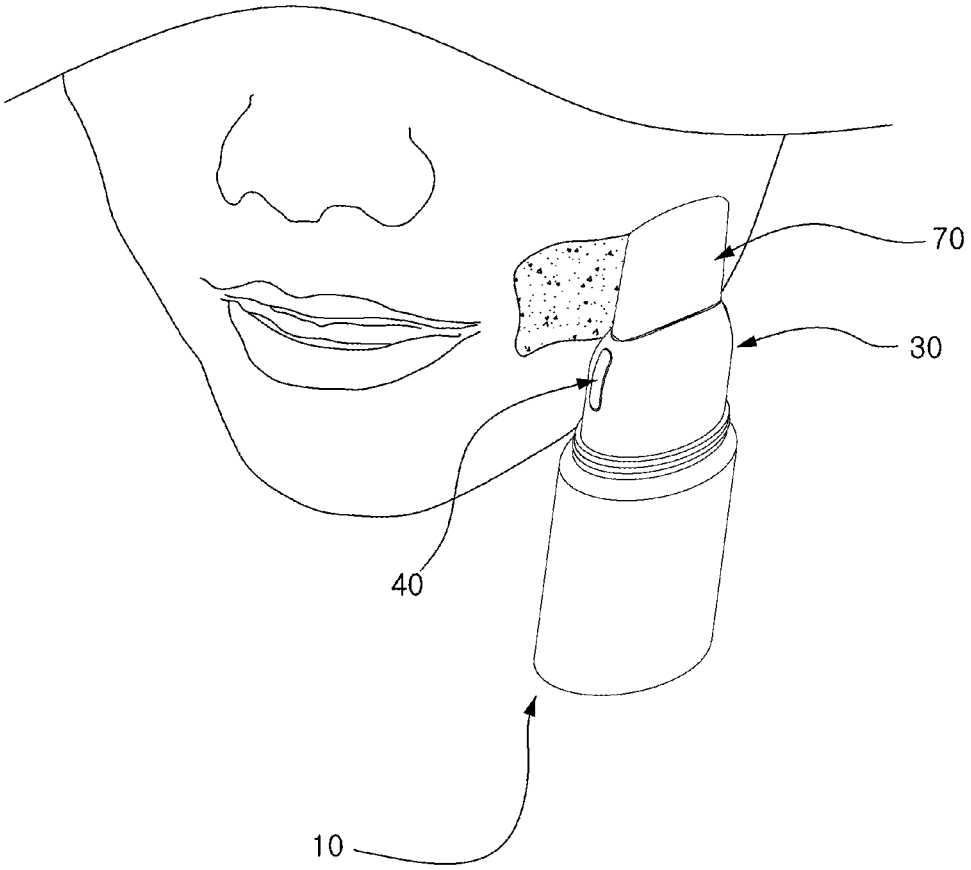
FIG. 9 is a perspective view showing a state in which makeup is performed by using a cosmetic tool of the cosmetic container according to one embodiment of the present invention.

FIG. 7 is a sectional view taken along line A-A to show a state in which an overcap of the cosmetic container is separated according to one embodiment of the present invention, FIG. 8 is a sectional view taken along line B-B to show a state in which a cosmetic material is discharged by pressing a container body of the cosmetic container according to one embodiment of the present invention, and FIG. 9 is a perspective view showing a state in which makeup is performed by using a cosmetic tool of the cosmetic container according to one embodiment of the present invention.

In order to use the cosmetic container having the discharge hole automatically opened/closed by the overcap according to the present invention, first, as shown in FIG. 7, the overcap 20 may be separated from the container body 10.

As described above, when the overcap 20 is separated, the horizontal pressing portion 42 of the operation member 40, which is pressed and contracted by the inner overcap 22, may extend to an original position thereof, that is, outward of the shoulder 30 so as to be exposed to the outside by the elastic force of the elastic supporting portion 44, and the opening/closing member 50 may be simultaneously moved upward by the elasticity of the elastic member 60.

Accordingly, as the opening/closing protrusion wheel 524 of the opening/closing member 50 may be moved upward between the opening/closing rod 321 and the upper inner wall 323 of the inner shoulder 32, the discharge groove 321*a* formed in the opening/closing rod 321 of the inner shoulder 32 may be opened, so that the first discharge hole 322 of the inner shoulder 32 may be opened.

In other words, as shown in the partially enlarged view of FIG. 5, the opening/closing protrusion wheel 524 may surround and block the discharge groove 321*a* of the opening/closing rod 321, and as the opening/closing member 50 moves upward, as shown in the partially enlarged view of FIG. 7, the lower end of the opening/closing protrusion wheel 524 may be located at the upper side of the discharge groove 321*a* of the opening/closing rod 321, so that the discharge groove 321*a* may be opened, and the first discharge hole 322 of the inner shoulder 32 may be opened.

Then, as shown in FIG. 8, when a side surface of the container body 10 is pressed, the cosmetic material accommodated in the container body 10 may sequentially pass through the first discharge hole 322 and the discharge groove 321*a* of the inner shoulder 32, the first discharge flow path 51 of the opening/closing member 50, and the second discharge flow path 73 of the cosmetic tool 70 so as to be discharged through the second discharge hole 72.

Thereafter, as shown in FIG. 9, the cosmetic tool 70 may be put on the skin to apply the discharged cosmetic material onto the skin, thereby performing the makeup.

After finishing the makeup, the overcap 20 may be coupled to the upper portion of the container body 10 so as to be stored or carried.

As described above, when the overcap 20 is coupled, as shown in FIG. 5, the inclined portion 221 of the inner overcap 22 of the overcap 20 may push the horizontal pressing portion 42 of the operation member 40 into the outer shoulder 34, so that the elastic supporting portion 44 of the operation member 40 may be bent while the horizontal pressing portion 42 is contracted, and the first inclined portion 422 formed at a lower portion of the horizontal pressing portion 42 of the operation member 40 may simultaneously push the second inclined portion 542 of the opening/closing member 50 downward.

Accordingly, the opening/closing protrusion wheel 524 of the opening/closing member 50 may move downward between the opening/closing rod 321 and the upper inner wall 323 of the inner shoulder 32, so that the discharge groove 321*a* formed in the opening/closing rod 321 of the inner shoulder 32 may be blocked, and the first discharge hole 322 of the inner shoulder 32 may be closed.

In other words, as shown in the partially enlarged view of FIG. 7, the lower end of the opening/closing protrusion wheel 524 may be located at the upper side of the discharge groove 321*a* of the opening/closing rod 321 so that the discharge groove 321*a* formed in the opening/closing rod 321 of the inner shoulder 32 and the first discharge hole 322 may be opened, and as the opening/closing member 50 moves downward, as shown in the partially enlarged view of FIG. 5, the opening/closing protrusion wheel 524 may surround the opening/closing rod 321 to block the discharge groove 321*a* formed in the opening/closing rod 321 so that the first discharge hole 322 of the inner shoulder 32 may be closed.

Accordingly, the use of the cosmetic container having the discharge hole automatically opened/closed by the overcap according to one embodiment of the present invention is completed.

As described above, although the cosmetic container having the discharge hole automatically opened/closed by the overcap according to one embodiment of the present invention has been described for illustrative purposes, the present invention is not limited thereto. It is understood that various changes and modifications can be made by those skilled in the art without departing from the spirit and scope of the present invention as disclosed in the appended claims.

[Description of Reference Numerals]

| | |
|---|---|
| 10: Container body | 12: Entrance portion |
| 20: Overcap | 22: Inner overcap |
| 24: Outer overcap | 30: Shoulder |
| 32: Inner shoulder | 34: Outer shoulder |
| 40: Operation member | 42: Horizontal pressing portion |
| 44: Elastic supporting portion | 50: Opening/closing member |
| 51: First discharge flow path | |
| 52: Opening/closing portion | |
| 54: Vertical pressing portion | |
| 60: Elastic member | 70: Cosmetic tool |
| 72: Second discharge hole | 73: Second flow path |
| 221: Inclined portion | 222: Sealing portion |

-continued

[Description of Reference Numerals]

| | |
|---|---|
| 321: Opening/closing rod | 322: First discharge hole |
| 422: First inclined portion | |
| 524: Opening/closing protrusion wheel | |
| 542: Second inclined portion | |

The invention claimed is:

1. A cosmetic container having a discharge hole automatically opened/closed by an overcap, the cosmetic container comprising:

a container body in which a cosmetic material is accommodated;

the overcap for opening/closing the container body;

a shoulder coupled to the container body and having a first discharge hole;

an operation member horizontally contracted by the overcap;

an opening/closing member vertically moved by the operation member to open/close the first discharge hole of the shoulder; and an elastic member for elastically supporting the opening/closing member, wherein when the overcap is closed, an inner peripheral surface of the overcap pushes the operation member into the shoulder, and the operation member simultaneously pushes the opening/closing member downward, so that the opening/closing member closes the first discharge hole of the shoulder, and wherein when the overcap is opened, the operation member is elastically restored to an original position thereof, and the opening/closing member is simultaneously moved upward by elasticity of the elastic member so as to open the first discharge hole of the shoulder.

2. The cosmetic container of claim 1, wherein the overcap includes an inner overcap and an outer overcap, and when the overcap is closed, an inclined portion formed in the inner overcap pushes the operation member into the shoulder to seal the container body.

3. The cosmetic container of claim 1, wherein a cosmetic tool having a second discharge hole is coupled to the shoulder, and the second discharge hole of the cosmetic tool is connected to the first discharge hole of the shoulder.

4. The cosmetic container of claim 1, wherein the shoulder includes an inner shoulder coupled to an entrance portion of the container body and an outer shoulder coupled to an upper portion of the inner shoulder, and the outer shoulder is formed at an outer periphery thereof with a pressing portion through-hole.

5. The cosmetic container of claim 1, wherein the operation member is formed at both sides thereof with a horizontal pressing portion and includes an elastic supporting portion for elastically supporting the horizontal pressing portion in an outward direction.

6. The cosmetic container of claim 1, wherein the opening/closing member is formed at a center thereof with an opening/closing portion and includes a vertical pressing portion formed at an outer side of the opening/closing portion so as to be vertically pressed by the operation member.

7. The cosmetic container of claim 1, wherein the operation member includes a first inclined portion, and the opening/closing member includes a second inclined portion having an inclined groove, so that the first inclined portion of the operation member is seated in the inclined groove of the opening/closing member.

* * * * *